US006710242B1

(12) United States Patent
Iguro et al.

(10) Patent No.: US 6,710,242 B1
(45) Date of Patent: Mar. 23, 2004

(54) CORE-SHEATH COMPOSITE CONDUCTIVE FIBER

(75) Inventors: Toshihiro Iguro, Hofu (JP); Masayuki Miyamoto, Hofu (JP); Shigeki Honda, Hofu (JP); Keiji Nakanishi, Sanda (JP); Hidenobu Tsutsumi, Hofu (JP)

(73) Assignees: Kanebo, Limited, Tokyo (JP); Kanebo Gohsen, Limited, Osaka (JP)

( * ) Notice: Subject to any disclaimer, the term of this patent is extended or adjusted under 35 U.S.C. 154(b) by 0 days.

(21) Appl. No.: 10/070,885

(22) PCT Filed: Sep. 7, 2000

(86) PCT No.: PCT/JP00/06112

§ 371 (c)(1),
(2), (4) Date: Jul. 22, 2002

(87) PCT Pub. No.: WO01/21867

PCT Pub. Date: Mar. 29, 2001

(30) Foreign Application Priority Data

Sep. 17, 1999 (JP) ..... 11-263413

(51) Int. Cl.[7] ..... H01B 7/34
(52) U.S. Cl. ..... 174/36; 428/372; 428/373
(58) Field of Search ..... 174/36, 121 R, 174/215 R, 122 R, 124 R, 110 R, 111, 119 R, 119 C, 120 R; 428/372, 373, 392, 375, 394, 395

(56) References Cited

U.S. PATENT DOCUMENTS 4,309,479 A * 1/1982 Naruse et al. ..... 428/397
4,756,969 A * 7/1988 Takeda ..... 428/372
5,593,778 A * 1/1997 Kondo et al. ..... 428/373
5,686,552 A * 11/1997 Masuda et al. ..... 528/193
5,924,920 A * 7/1999 DeLuca et al. ..... 454/62

FOREIGN PATENT DOCUMENTS

| | | | |
|---|---|---|---|
| JP | 52-56394 | 5/1977 | |
| JP | 57-25647 | 5/1982 | |
| JP | 57-111874 | 7/1982 | |
| JP | 61-201008 | 9/1986 | |
| JP | 62-94014 | 10/1994 | |
| JP | 72-78956 | 10/1995 | |
| JP | 07-278956 A * | 10/1995 | ..... D01F/6/92 |
| JP | 80-74125 | 3/1996 | |
| JP | 11-065227 | 3/1999 | |

* cited by examiner

*Primary Examiner*—William H Mayo, III
(74) *Attorney, Agent, or Firm*—Flynn, Thiel, Boutell & Tanis, P.C.

(57) ABSTRACT

A sheath-core composite conductive fiber having a sheath component made of a fiber-forming polymer containing conductive carbon black, is characterized in that, with respect to an inscribed circle of a core component and an inscribed circle of a sheath component in a cross section of the fiber, a radius (R) of the inscribed circle of the sheath component and a distance (r) between the centers of two inscribed circles satisfy a specific relationship, and a sheath-core composite conductive fiber having: a core component made of a polyester containing ethylene terephthalate as a main component, and a sheath component made of a mixture of a copolyester wherein ethylene terephthalate accounts for 10 to 90 mol % of constituent units thereof and carbon black. The conductive fiber can be used alone or in combination with other fibers in various applications, e.g., special working clothes such as dust-free clothes and interiors such as carpets.

8 Claims, 1 Drawing Sheet

FIG. 1
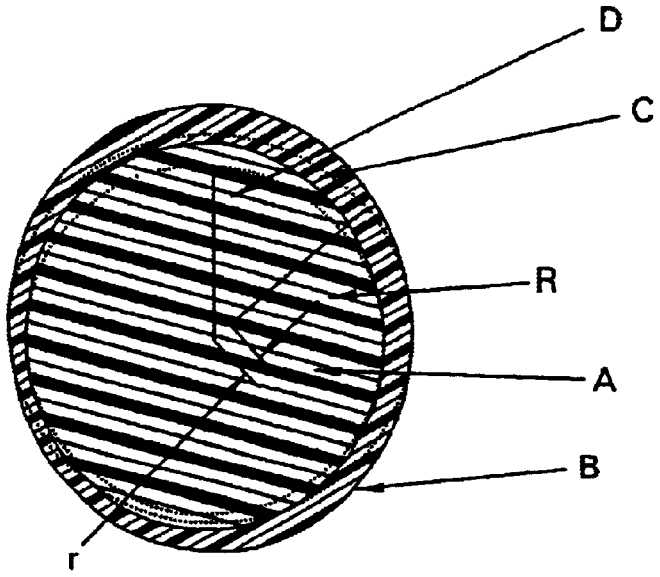
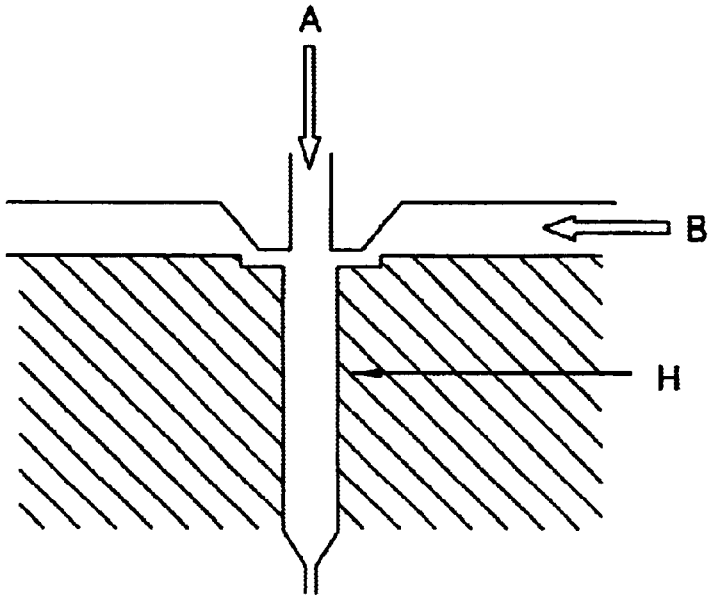
FIG. 2

CORE-SHEATH COMPOSITE CONDUCTIVE FIBER

TECHNICAL FIELD

The present invention relates to a sheath-core composite conductive fiber.

BACKGROUND ART

Composite fibers produced by coating a conductive component containing conductive particles with a non-conductive component have conventionally been used as conductive fibers.

In Europe and America, a method of measuring a resistance value while contacting an electrode at two positions on the surface of a textile product (hereinafter referred to a surface resistance measuring method) has recently been employed as a means for evaluating the conductivity without breaking the textile product. This method has the problem that the measured apparent conductivity is low, namely, the measured resistance value becomes higher in case of a conductive yarn wherein a conductive yarn is mixed with a textile product not having a surface conductive layer because a conductive component is not contacted with an electrode.

It is easy for us to get a suggestion that the surface layer is made of a conductive component in order to solve such a drawback, and various suggestions have been made. For example, a method of coating the surface with a metal such as titanium oxide or cuprous iodide has been suggested. According to such a method, the resulting product has insufficient washing durability and exhibits high conductivity at an initial stage, but the metal is peeled off during washing, thereby to lower conductive performances. Therefore, the method is not suited for use in dust-free clothes which indispensably require washing.

Although a sheath-core composite fiber comprising a sheath composed of a conductive layer containing carbon black incorporated therein has been suggested in Japanese Examined Patent Publication No. 57-25647, it was not a product suited for practical use because sheath-core formation of the sheath-core composite fiber is not easily performed. Since the presence of carbon black drastically lowers the spinnability of a thermoplastic resin, a core portion and a sheath portion of a composite component differ in thermal fluidity, and thus the spinnability drastically becomes worse. Furthermore, there was the problem that the operability is also lowered in post processes such as drawing process and weaving/knitting process because the sheath-core composite shape partially becomes un-uniform due to the same reason.

An object of the present invention is to provide a sheath-core composite conductive fiber which is superior in conductivity in a surface resistance measuring method and durability of conductivity, and also which has good passableness in the spinning process and the post process.

DISCLOSURE OF THE INVENTION

The present inventors have studied with paying attention to the fact that the coherency and waviness of a conductive fiber are improved and the passableness in the post process is remarkably improved by controlling the center of an inscribed circle of a sheath component in a cross section of a sheath-core composite fiber obtained by a melt-spinning process, which comprises a sheath component made of a fiber-forming polymer containing conductive carbon black, within a specific range, thus completing the present invention.

A first invention of the present invention provides a sheath-core composite conductive fiber comprising a sheath component made of a fiber-forming polymer containing conductive carbon black, characterized in that, with respect to an inscribed circle of a core component and an inscribed circle of a sheath component in a cross section of the fiber, a radius (R) of the inscribed circle of the sheath component and a distance (r) between the centers of two inscribed circles satisfy the following relationship:

$$r/R \leqq 0.03 \quad (1)$$

In a preferred aspect of the first invention, the carbon black content of the sheath component is within a range from 10 to 50% by weight.

In a more preferred aspect, a core-sheath ratio is within a range from 20:1 to 1:2 in terms of an area ratio of the core component to the sheath component.

A second invention of the present invention provides a sheath-core composite conductive fiber comprising:

a core component made of a polyester containing ethylene terephthalate as a main component, and a sheath component made of a mixture of a copolyester wherein ethylene terephthalate accounts for 10 to 90 mol % of constituent units thereof and carbon black.

In a preferred aspect of the second invention, the sheath component is a polyester prepared by copolymerizing isophthalic acid and/or orthophthalic acid and/or naphthalenedicarboxylic acid as the copolymer of the acid component.

In a more preferred aspect, a copolymerization ratio of isophthalic acid and/or orthophthalic acid and/or naphthalenedicarboxylic acid as the copolymerization component is within a range from 10 to 50 mol %.

In a more preferred aspect, the carbon black content of the sheath component is within a range from 10 to 50% by weight.

In a more preferred aspect, a core-sheath ratio is within a range from 20:1 to 1:2 in terms of an area ratio of the core component to the sheath component.

BRIEF DESCRIPTION OF DRAWINGS

FIG. 1 is a view showing a cross-sectional shape of a fiber of the present invention, and FIG. 2 is a view showing an example of a spinneret used in the production of the fiber of the present invention. In the drawings, reference numerals denote the followings.

A: Core polymer
B: Sheath polymer containing conductive carbon
C: Inscribed circle of sheath
D: Inscribed circle of core
R: Radius of inscribed circle of sheath
r: Distance between center of inscribed circle of sheath and center of inscribed circle of core
H: Wall surface of lead hole of flow channel of conductive polymer

BEST MODE FOR CARRYING OUT THE INVENTION

First, the first invention will be described.

The present invention relates to a sheath-core composite conductive fiber comprising a core component made of a fiber-forming polymer and a sheath component made of a fiber-forming polymer containing conductive carbon black.

As shown in FIG. 1, which shows a cross-sectional shape of the conductive fiber of the present invention, the fiber-forming polymer, which constitutes the core component, is located at the inside of the fiber-forming polymer containing conductive carbon black, which constitutes the sheath component. In such a cross-sectional shape, a radius R of an inscribed circle of the sheath component and a distance r between the center of an inscribed circle of the sheath component and the center of an inscribed circle of the core component has a specific relationship.

A publicly known polymer having fiber-forming performances, for example, polyamide, polyester, or polyolefin is useful as the fiber-forming polymer, which constitutes the core component. As the polyamide, for example, nylon 6, nylon 66, nylon 11, nylon 12, and copolyamide containing the polyamide as a main component are well known. As the polyester, for example, polyethylene terephthalate, polybutylene terephthalate, polyethylene oxide benzoate, and copolyester containing the polyester as a main component are well known. The polymer other than those described above can be applied as the fiber-forming polymer, which constitutes the core component, in the present invention as far as it is a polymer having fiber-forming performances. According to the purposes, the polymer may contain inorganic particles such as titanium particles.

A publicly known polymer having fiber-forming performances, for example, polyamide or polyester is useful as the conductive carbon black-containing fiber-forming polymer, which constitutes the sheath component. As the polyamide, for example, nylon 6, nylon 66, nylon 11, nylon 12, and copolyamide containing the polyamide as a main component are well known. As the polyester, for example, polyethylene terephthalate, polybutylene terephthalate, polyethylene oxide benzoate, and copolyester containing the polyester as a main component are well known. The polymer other than those described above can be applied as the fiber-forming polymer, which constitutes the core component, in the present invention as far as it is a polymer having fiber-forming performances.

The sheath-core composite conductive fiber, which does not satisfy the relationship ① between r and R, has poor coherency of yarn because of decentering of the core component, and also has poor passableness of the post process because of the waviness. With respect to the sheath-core composite conductive fiber, which satisfies the relationship, decentering of the core component does not occur and the passableness of the spinning process and post process is excellent because of less waviness.

In the present invention, in order to locate the core and sheath to satisfy the relationship ①, the roughness of the wall surface H of a lead hole of a flow channel of the fiber-forming polymer, which constitutes the sheath component, of a spinneret nozzle is controlled to 1.6S or less. Furthermore, when the flow channel of the polymer in the vicinity of a capillary portion inlet is narrow down or the flow channel is streamlined, the fluidity of the polymer is further improved and the splinability becomes superior.

In this case, when the roughness of the wall surface H in the vicinity of the capillary portion inlet of the spinneret nozzle is controlled to 1.6S or more, it becomes hard to enable the fiber-forming polymer, which constitutes the sheath component, to flow and thus the core and sheath are scarcely formed. In this case, when the spinning temperature is raised to reduce the melt viscosity of the fiber-forming polymer, which constitutes the sheath component, deterioration of the polymer is accelerated. thereby to cause contamination of the spinneret and to form no line of thread, sometimes.

The content of the conductive carbon black in the fiber-forming polymer, which constitutes the sheath component, is preferably within a range from 10 to 50% by weight, and more preferably from 15 to 40% by weight. When the content of the conductive carbon black is within the above range, the resulting fiber is superior in fiber-forming performances and conductivity. Therefore, it is preferred.

The conductive carbon black can be mixed with the fiber-forming polymer by a publicly known method, for example, kneading with heating using a twin-screw extruder.

The core-sheath ratio of the sheath-core composite conductive fiber of the present invention is preferably within a range from 20:1 to 1:2 in terms of an area ratio of the core component to the sheath component. When the core-sheath ratio is within the above range, the resulting fiber is superior in strength of the fiber and sheath-core formation.

Next, the second invention of the present application will be described. This invention particularly relates to a polyester fiber among the sheath-core composite conductive fiber wherein the sheath component is a conductive component. The use of a polyester material makes it possible to improve the conductivity, durability of conductivity and passableness of the spinning process and post process, and to obtain a conductive fiber having excellent chemical resistance. The copolyester as the sheath component of the sheath-core composite conductive fiber of the present invention is a copolyester wherein ethylene terephthalate accounts for 10 to 90 mol % of constituent units thereof.

Various components can be used as the copolymerization component of the copolyester, as the sheath component. Examples thereof include dicarboxylic acids such as isophthalic acid, orthophthalic acid and naphthalenedicarboxylic acid; and glycols (diols) such as polyethylene glycol. Among these components, isophthalic acid, orthophthalic acid and naphthalenedicarboxylic acid are preferably used. A copolymerization ratio thereof is preferably within a range from 10 to 50 mol %. and more preferably from 10 to 40 mol %.

This copolymerization ratio means a ratio in an acid component in case of dicarboxylic acids, while it means a ratio in a glycol component in case of glycols.

When the copolymerization ratio is smaller than 10 mol %, a sheath-core structure is not formed. In this case, protrusions are formed on the surface of the fiber and, furthermore, the polymer does not penetrate into the sheath portion of a single layer of a portion of the fiber and the resulting fiber is composed of only a core component. Such a fiber is drastically inferior in process passableness such as spinnability, drawability or post processability. On the other hand, when the copolymerization ratio exceeds 90 mol %, the melting point is reduced and the polymer is deteriorated by heating to the spinning temperature required to the core component, thereby to cause yarn breakage and to drastically lower the spinnability.

The core component in the sheath-core composite conductive fiber of the present invention is a homoester or copolyester containing ethylene terephthalate as a main component, and is preferably a homo PET (polyethylene terephthalate). Examples of the copolymerization component used in the copolyester include dicarboxylic acid component such as adipic acid, sebacic acid, phthalic acid, naphthalenedicarboxylic acid, or sulfoisophthalic acid; hydroxycarboxylic acid component such as 1-hydroxy-2-carboxyethane; and diol component such as ethylene glycol, diethylene glycol, or triethylene glycol tetraethylene glycol. Among these components, sulfoisophthalic acid is preferably used. When using a copolyester, the copolymerization ratio of the copolyester is preferably within a range from 10 to 30 mol %. According to the purposes, the copolyester may contain inorganic particles such as titanium oxide particles.

The content of carbon black of the sheath component in the sheath-core composite conductive fiber is preferably within a range from 10 to 50% by weight. When the content of carbon black is within the range described above, a fiber having excellent fiber-forming capability and conductivity can be obtained.

The conductive carbon black can be mixed with the copolyester by a publicly known method, for example, kneading with heating using a twin-screw extruder.

It is essential that a composite structure of a conductive component and a non-conductive component of the sheath-core composite conductive fiber of the present invention is a sheath-core structure wherein the conductive component completely surrounds the non-conductive component. FIG. 1 is a view showing an example of a composite structure suited for use in the present invention.

The core-sheath ratio of the sheath-core composite conductive fiber of the present invention is preferably within a range from 1:2 to 20:1 (core:sheath) in terms of an area ratio of the core component to the sheath component. When the sheath component satisfies the range described above, a fiber having excellent fiber-forming properties and conductivity can be obtained. Therefore, it is preferred.

EXAMPLES

The following Examples further illustrate the present invention in detail.

First, the method of measuring values of physical properties and the evaluation method thereof are described.

The surface resistance was measured in the following manner. Using a sample (60 mm in a weft direction, 50 mm in a warp direction) made of a cloth produced by mixing, as a warp, a sheath-core composite conductive fiber at a pitch of 10 mm, An electrode contacted with the whole 50 mm in the warp direction was brought into contact with the cloth, 50 mm apart in the weft direction a resistance value was measured under the conditions in the absence of a conductive paste. A high resistance meter 4329A manufactured by Hewlett-Packard Company was used as a resistance meter.

The case where the distance between the centers of inscribed circles of the sheath and the core of the fiber (hereinafter referred to as a distance between centers) satisfies the relationship ① was rated "good (○)", while the other cases were rated "poor (X)". After taking a micrograph of a cross section of a yarn using an optical microscope manufactured by OLYMPUS OPTICAL CO., LTD., the distance between centers was measured by an image analyzer manufactured by KEYENCE CORPORATION.

The process passableness was evaluated. The case where taken-up of a spun yarn, unwinding of a bobbin during drawing and unwiding properties of a pirn during post process are good was rated "good (○)", while the case where they are inferior were 13 rated "poor (X)".

The MI value was measured by using a meter type C-5059D manufactured by Toyo Seiki Seisaku-Sho, Ltd. A resin was melted at a specific temperature and the molten resin was extruded through an orifice having a diameter of 0.5 mm for 10 minutes, and then the weight of the resin discharged was taken as the MI value.

The washing durability was evaluated whether or not an increase in resistance value was recognized after washing 100 times, using the method defined in JIS L0217 E103. The case where an increase in resistance value was not recognized after washing 100 times was rated "good (○)", while the case where an increase in resistance value was recognized was rated "poor (X)".

The acid resistance was evaluated whether or not dissolution occurred after immersing in 95% formic acid. The case where dissolution did not occur after about 5 minutes have passed since the beginning of immersion was rated "good (○)", while dissolution occurred was rated "poor (X)", The sheath-core formation state of the fiber was evaluated. The case where the whole filaments have a sheath-core structure were rated "good (○)", while the other cases were rated "poor (X)".

The strength of the fiber was measured by Autograph AGS-1KNG manufactured by Shimadzu Corporation.

Example 1-1

A conductive polymer prepared by dispersing 26% by weight of conductive carbon black into polyethylene terephthalate. prepared by copolymerizing 12 mol % of isophthalic acid, as a sheath component, and homopolyethylene terephthalate, as a core component, are combined in a core/sheath ratio shown in Table 1-1. The resulting composite material was melt-spun through a spinneret orifice having a bore diameter of 0.5 mm at 285° C. under the condition that the roughness of the wall surface H of a lead hole of a flow channel of a conductive polymer is not more than 1.6S, and then taken up at a speed of 1000 m/min while oiling with an oiling agent to obtain an undrawn yarn of 12 filaments with a circular cross section. The undrawn yarn was further drawn by passing through a drawing roller at 100° C., heat-treated on a hot plate at 140° C. and then taken up to obtain a drawn yarn having 84 decitex per 12 filaments. The evaluation results are shown in Table 1-1.

Example 1-2

A conductive polymer prepared by dispersing 33% by weight of conductive carbon black into nylon 12, as a sheath component, and nylon 12, as a core component, are combined in a core/sheath ratio shown in Table 1. The resulting composite material was melt-spun through a splnneret orifice having a bore diameter of 0.7 mm at 270° C. under the condition that the roughness of the wall surface H of a lead hole of a flow channel of a conductive polymer is not more than 1.6S, and then taken up at a speed of 700 m/min while oiling with an oiling agent to obtain an undrawn yarn of 24 filaments with a circular cross section. The undrawn yarn was further drawn by passing through a drawing roller at 90° C. heat-treated on a hot plate at 150° C. and then taken up to obtain a drawn yarn having 167 decitex per 24 filaments. The evaluation results are shown in Table 1-1.

Example 1-3

A conductive polymer prepared by dispersing 30% by weight of conductive carbon black into nylon 6, as a sheath component, and nylon 6, as a core component, are combined in a core/sheath ratio shown in Table 1. The resulting composite material was melt-spun through a spinneret orifice having a bore diameter of 0.5 mm at 270° C. under the condition that the roughness of the wall surface H of a lead hole of a flow channel of a conductive polymer is not more than 1.6S, and then taken up at a speed of 700 m/min while oiling with an oiling agent to obtain an undrawn yarn of 24 filaments with a circular cross section. The undrawn yarn was further drawn by passing through a drawing roller at 90° C., heat-treated on a hot plate at 150° C. and then taken up to obtain a drawn yarn having 160 decitex per 24 filaments. The evaluation results are shown in Table 1-1.

Example 1-4

A conductive polymer prepared by dispersing 23% by weight of conductive carbon black into polyethylene terephthalate prepared by copolymerizing polyethylene glycol, as a sheath component, and homopolyethylene terephthalate, as a core component, are combined in a core/sheath ratio shown in Table 1. The resulting composite material was melt-spun through a spinneret orifice having a bore diameter of 0.5 mm at 285° C. under the condition that the roughness of the wall surface H of a lead hole of a flow channel of a conductive polymer is not more than 1.6S, and then taken up at a speed of 1000 m/min while oiling with an oiling agent to obtain an undrawn yarn of 12 filaments with a circular cross section. The undrawn yarn was further drawn by passing through a drawing roller at 100° C., heat-treated on a hot plate at 140° C. and then taken up to obtain a drawn yarn having 84 decitex per 12 filaments. The evaluation results are shown in Table 1-1.

Comparative Example 1-1

A conductive polymer prepared by dispersing 26% by weight of conductive carbon black into polyethylene terephthalate prepared by copolymerizing 12 mol % of isophthalic acid, as a sheath component, and homopolyethylene terephthalate, as a core component, are combined in a core-sheath ratio shown in Table 1-1. The resulting composite material was melt-spun through a spinneret orifice having a bore diameter of 0.5 mm at 285° C. under the condition that the roughness of the wall surface H of a lead hole of a flow channel of a conductive polymer is not less than 3.2S. and then taken up at a speed of 1000 m/min while oiling with an oiling agent to obtain an undrawn yarn of 12 filaments with a circular cross section. The undrawn yarn was further drawn by passing through a drawing roller at 100° C. heat-treated on a hot plate at 140° C. and then taken up to obtain a drawn yarn having 84 decitex per 12 filaments. The evaluation results are shown in Table 1-1.

Comparative Example 1-2

A conductive polymer prepared by dispersing 33% by weight of conductive carbon black into nylon 12, as a sheath component, and nylon 12, as a core component, are combined in a core-sheath ratio shown in Table 1. The resulting composite material was melt-spun through a spinneret orifice having a bore diameter of 0.7 mm at 270° C. under the condition that the roughness of the wall surface H of a lead hole of a flow channel of a conductive polymer is not less than 3.2S, and then taken up at a speed of 700 m/min while oiling with an oiling agent to obtain an undrawn yarn of 24 filaments with a circular cross section. The undrawn yarn was further drawn by passing through a drawing roller at 90° C., heat-treated on a hot plate at 150° C. and then taken up to obtain a drawn yarn having 167 decitex per 24 filaments. The evaluation results are shown in Table 1-1.

Comparative Example 1-3

A conductive polymer prepared by dispersing 30% by weight of conductive carbon black into nylon 6, as a sheath component, and nylon 6, as a core component, are combined in a core-sheath ratio shown in Table 1. The resulting composite material was melt-spun through a spinneret orifice having a bore, diameter of 0.5 mm at 270C. under the condition that the roughness of the wall surface H of a lead hole of a flow channel of a conductive polymer is not less than 3.2S, and then taken up at a speed of 700 m/min while oiling with an oiling agent to obtain an undrawn yarn of 24 filaments with a circular cross section. The undrawn yarn was further drawn by passing through a drawing roller at 90° C., heat-treated on a hot plate at 150° C. and then taken up to obtain a drawn yarn having 160 decitex per 24 filaments. The evaluation results are shown in Table 1-1.

Comparative Example 1-4

A conductive polymer prepared by dispersing 23 % by weight of conductive carbon black into polyethylene terephthalate prepared by copolymerizing polyethylene glycol, as a sheath component, and polyethylene terephthalate, as a core component, are combined in a core/sheath ratio shown in Table 1-1. The resulting composite material was melt-spun through a spinneret orifice having a bore diameter of 0.5 mm at 285° C., under the condition that the roughness of the wall surface h of a lead hole of a flow channel of a conductive polymer is not less than 3.2S, and then taken up at a speed of 1000 m/min while oiling with an oiling agent to obtain an undrawn yarn of 12 filaments with a circular cross section. The undrawn yarn was further drawn by passing through a drawing roller at 100° C., heat-treated on a hot plate at 140° C. and then taken up to obtain a drawn yarn having 84 decitex per 12 filaments. The evaluation results are shown Table 1-1.

TABLE 1-1

| | Sheath component | | | |
|---|---|---|---|---|
| | Polymer | Content of conductive carbon (% by weight) | Core component | Core-sheath ratio (core/sheath) |
| Example 1-1 | Isophthalic acid copolymerized PET | 26 | PET | 5/1 |
| Example 1-2 | Nylon 12 | 33 | Nylon 12 | 5/1 |
| Example 1-3 | Nylon 6 | 30 | Nylon 6 | 5/1 |
| Example 1-4 | PEG copolymerized PET | 23 | PET | 5/1 |
| Comp. Example 1-1 | Isophthalic acid copolymerized PET | 26 | PET | 5/1 |
| Comp. Example 1-2 | Nylon 12 | 33 | Nylon 12 | 5/1 |
| Comp. Example 1-3 | Nylon 6 | 30 | Nylon 6 | 5/1 |
| Comp. Example 1-4 | PEG copolymerized PET | 23 | PET | 5/1 |

| | Roughness (S) | Distance between centers | Process passableness | Resistance value (Ω/cm) |
|---|---|---|---|---|
| Example 1-1 | 1.6 | ○ | ○ | $5.0 \times 10^{7}$ |
| Example 1-2 | 1.6 | ○ | ○ | $1.0 \times 10^{9}$ |
| Example 1-3 | 1.6 | ○ | ○ | $5.3 \times 10^{8}$ |
| Example 1-4 | 1.6 | ○ | ○ | $4.6 \times 10^{12}$ |
| Comp. Example 1-1 | 3.2 | X | X | $7.0 \times 10^{8}$ |
| Comp. Example 1-2 | 3.2 | X | X | $5.2 \times 10^{8}$ |
| Comp. Example 1-3 | 3.2 | X | X | $4.1 \times 10^{8}$ |
| Comp. Example 1-4 | 3.2 | X | X | $2.7 \times 10^{12}$ |

Example 2-1

A conductive polymer having a MI value of 0.02 prepared by dispersing 26% by weight of conductive carbon black into polyethylene terephthalate prepared by copolymerizing 30 mol % of isophthalic acid, as a sheath component, and polyethylene terephthalate (PET) having a MI value of 2.1, as a core component, are combined in a core-sheath ratio shown in Table 1-1. The resulting composite material was melt-spun through a splnneret orifice having a bore diameter of 0.25 mm at 290° C. and then taken up at a speed of 700 m/min while oiling with an oiling agent to obtain an undrawn yarn of 12 filaments with a circular cross section. The undrawn yarn was further drawn by passing through a drawing roller at 100° C., heat-treated on a hot plate at 140° C. and then taken up to obtain a drawn yarn having 84 desltex per 12 filaments. The evaluation results are shown in Table 2-1.

Example 2-2

The same operation as in Example 2-1 was repeated, except that the copolyester was changed as shown in Table 2-1. The evaluation results are shown in Table 2-1.

Comparative Example 2-1

The same operation as in Example 2-1 was repeated, except that the copolyester and the core-sheath ratio in Example 2-1 were changed as shown in Table 2-1. The evaluation results are shown in Table 2-1. Since a yarn could not be obtained under the conditions of Comparative Example 2-1, the surface resistance, strength, washing durability and formic acid resistance could not be evaluated.

Comparative Example 2-2

The same operation as in Example 2-1 was repeated, except that the copolyester in Example 2-1 was changed as shown in Table 2-1. The evaluation results are shown in Table2-1. Since a yarn could not be obtained under the conditions of Comparative Example 2-2, the surface resistance, strength, washing durability and formic acid resistance could not be evaluated.

Example 2-3

The same operation as in Example 2-1 was repeated, except that the core-sheath ratio in Example 2-1 was changed as shown in Table 2-1. The evaluation results are shown in Table 2-1.

Comparative Example 2-3

The same operation as in Example 2-1 was repeated, except that the core component in Example 2-1 was changed to 6 nylon (6 Ny) and the core-sheath ratio was changed as shown in Table 2-1. The evaluation results are shown in Table 2-1.

TABLE 2-1

| | Example 2-1 | Example 2-2 | Example 2-3 | Comp. Example 2-1 | Comp. Example 2-2 | Comp. Example 2-3 |
|---|---|---|---|---|---|---|
| Sheath component | | | | | | |
| Carbon black content (% by weight) | 26 | 26 | 26 | 26 | 26 | 30 |
| Isophthalic acid copolymerization ratio (mol %) | 30 | 12 | 30 | 0 | 93 | 30 |
| MI value | 0.02 | 0.09 | 0.02 | 0.01 | 0.01 | 2.5 |
| Core component | | | | | | |
| Polymer* | PET | PET | PET | PET | PET | 6Ny |
| MI value | 2.1 | 2.1 | 2.1 | 2.1 | 2.1 | 3.1 |
| Core-sheath ratio (core/sheath) | 4:1 | 4:1 | 2:1 | 3:1 | 4:1 | 4:1 |
| Surface resistance/$10^7$ (Ω) | 3.3 | 1.5 | 2.0 | — | — | 2.8 |
| Strength (cN/dtex) | 2.6 | 1.8 | 2.1 | — | — | 1.9 |
| Core-sheath formation state | ○ | ○ | ○ | X | X | ○ |
| Washing durability | ○ | ○ | ○ | — | — | ○ |
| Formic acid resistance | ○ | ○ | ○ | — | — | X |
| Process passableness | ○ | ○ | ○ | X | X | ○ |

Polymer*; PET: polyethylene terephthalate
6 Ny: 6 nylon
—: immpossible to measure

INDUSTRIAL APPLICABILITY

The sheath-core composite conductive fiber of the present invention is in the form that the conductive component completely surrounds the non-conductive component and the conductive component is exposed to the whole surface in a cross-sectional shape of the fiber, and has good passableness of the spinning process and post process. Furthermore, a composite conductive fiber having excellent chemical resistance can-be obtained by constituting the core component and the sheath component using a specific polyester.

The conductive fiber of the present invention can be used alone or in combination with other fibers in various applications. Examples of the purpose for which the conductive fiber of the present invention can be used include special working clothes such as dust-free clothes, and interiors such as carpets.

What is claimed is:

1. A sheath-core composite conductive fiber comprising a sheath component made of a fiber-forming polymer containing conductive carbon black, characterized in that a core component and the sheath component satisfies the following relationship:

$$r/R \leqq 0.03 \quad (1)$$

where R represents a radius of an inscribed circle of the sheath component and r represents the distance between the centers of two inscribed circles of the core and sheath components in a cross section of the fiber.

2. The sheath-core composite conductive fiber according to claim 1, wherein the carbon black content of the sheath component is within a range from 10 to 50% by weight.

3. The sheath-core composite conductive fiber according to claim 1, wherein a core-sheath ratio is within a range from 20:1 to 1:2 in terms of an area ratio of the core component to the sheath component.

4. The sheath-core composite conductive fiber according to claim 1, wherein the core component is made of a polyester containing ethylene terephthalate as a main component, and the sheath component is made of a mixture of a copolyester wherein ethylene terephthalate accounts for 10 to 90 mol % of constituent units thereof and carbon black.

5. The sheath-core composite conductive fiber according to claim 4, wherein the sheath component comprises a polyester prepared by copolymerizing a copolymerization component selected from the group consisting of isophthalic acid, orthophthalic acid and naphthalenedicarboxylic acid.

6. The sheath-core composite conductive fiber according to claim 4, wherein a copolymerization ratio of the copolymerization component of the sheath component is within a range from 10 to 50 mol %.

7. The sheath-core composite conductive fiber according to claim 4, wherein the carbon black content of the sheath component is within a range from 10 to 50% by weight.

8. The sheath-core composite conductive fiber according to claim 4, wherein a core-sheath ratio is within a range from 20:1 to 1:2 in terms of an area ratio of the core component to the sheath component.

* * * * *